US010224662B2

(12) United States Patent
Kimura et al.

(10) Patent No.: US 10,224,662 B2
(45) Date of Patent: Mar. 5, 2019

(54) CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Akio Kimura, Mie (JP); Seido Nishijima, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 15/770,784

(22) PCT Filed: Oct. 11, 2016

(86) PCT No.: PCT/JP2016/080051
§ 371 (c)(1),
(2) Date: Apr. 25, 2018

(87) PCT Pub. No.: WO2017/073306
PCT Pub. Date: May 4, 2017

(65) Prior Publication Data

US 2018/0316115 A1 Nov. 1, 2018

(30) Foreign Application Priority Data

Oct. 28, 2015 (JP) ..... 2015-212078

(51) Int. Cl.
*H01R 13/40* (2006.01)
*H01R 13/24* (2006.01)

(52) U.S. Cl.
CPC ..... *H01R 13/40* (2013.01); *H01R 13/2442* (2013.01)

(58) Field of Classification Search
CPC ..... H01R 13/40; H01R 13/42; H01R 13/2442
(Continued)

(56) References Cited

U.S. PATENT DOCUMENTS 5,716,230 A 2/1998 Marren et al.
6,554,640 B1 * 4/2003 Koike ..... H01R 13/6315 429/97

(Continued)

FOREIGN PATENT DOCUMENTS

JP 11-162592 6/1989
JP 3035814 2/2000

(Continued)

OTHER PUBLICATIONS

International Search Report and Written Opinion dated Nov. 22, 2016.

*Primary Examiner* — Khiem Nguyen
(74) *Attorney, Agent, or Firm* — Gerald E. Hespos; Michael J. Porco; Matthew T. Hespos

(57) ABSTRACT

A connector (1) includes a terminal (10) and a housing (H) for accommodating the terminal. The terminal (10) includes a case (20) having a ceiling wall (21) and accommodated in the housing, a coil spring (30) accommodated inside the case while being compressed in a compression direction toward the ceiling wall of the case, and a first conductive member (40) having a contact portion (43) with a mating terminal and sandwiched between one end (31) of the coil spring and an inner wall of the case, the contact portion being movable in the compression direction to further compress the coil spring. The case (20) is made of a metal material.

4 Claims, 13 Drawing Sheets

(58) Field of Classification Search
USPC ..... 439/625–628
See application file for complete search history.

(56) References Cited

U.S. PATENT DOCUMENTS

| | | | | |
|---|---|---|---|---|
| 6,869,805 | B2 * | 3/2005 | Kubisch | H01R 13/2407 436/500 |
| 8,668,529 | B2 * | 3/2014 | Park | H01R 12/714 439/700 |

FOREIGN PATENT DOCUMENTS

| | | |
|---|---|---|
| JP | 2002-274290 | 9/2002 |
| JP | 2003-031194 | 1/2003 |

* cited by examiner

CONNECTOR

BACKGROUND

Field of the Invention. This specification relates to a connector, particularly to a case included in the connector and configured to accommodate a conductive member that is movable when the connector is connected.

Description of the Related Art. Japanese Unexamined Patent Publication No. 2002-274290 discloses a power supply device in which contacts are electrically connected by being butted against each other. This power supply device is composed of a female junction provided on a body side of a vehicle and a male junction provided on a door side. The female junction is provided such that one end of a hollow cylindrical case faces outside from the body. Left and right end plates are provided inside the case, a coil spring is sandwiched and compressed between the end plates. A leaf spring also is provided in the case and is connected to the coil spring.

However, the above power supply device has seats formed from insulating materials provided on the end plates, and end parts of the coil spring are accommodated in these recesses. A contact pressure by the coil spring when the female junction and the male junction are connected is received by the recesses of the end plates. Thus, a creep phenomenon may occur on the end plates if a high contact pressure (biasing force) from the coil spring is applied to the recesses of the end plates or an environmental temperature is high when the end plates are made of synthetic resin. The creep phenomenon may lead to resin collapse and may reduce the reliability of the power supply device.

This specification was completed on the basis of the above situation and a connector capable of coping with a high environmental temperature and a large biasing force of a coil spring is provided in this specification.

SUMMARY

A connector disclosed by this specification has a terminal and a housing for accommodating the terminal. The terminal includes a case accommodated in the housing, and the case has a ceiling wall. A coil spring is accommodated inside the case while being compressed in a compression direction toward the ceiling wall of the case. A first conductive member has a contact portion for contacting a mating terminal. The first conductive member is sandwiched between one end of the coil spring and an inner wall of the case. The contact portion is movable in the compression direction to further compress the coil spring. The case is made of a metal material.

In this configuration, the case for accommodating the first conductive member is movable in the direction to compress the coil spring further and is made of the metal material. Thus, when the terminal contacts the mating terminal, the contact portion of the first conductive member further compresses the coil spring. Accordingly, a creep phenomenon does not occur in the case at a high environmental temperature even if the ceiling wall of the case receives a high contact pressure (biasing force) from the coil spring. Specifically, the connector having this configuration can cope with a high environmental temperature and a large biasing force of the coil spring.

The housing may include an upper wall configured to contact the ceiling wall of the case at least when the first conductive member is moved in the compression direction to compress the coil spring further. According to this configuration, when the terminal contacts the mating terminal, the biasing force of the coil spring is transmitted to the housing via the ceiling wall of the case. Specifically, the biasing force of the coil spring also can be received by the housing, and a structure for receiving the biasing force of the coil spring is a double structure. Thus, a thickness of the metallic case can be reduced as compared to the case where the biasing force of the coil spring is received only by the metallic case, and the connector can be reduced in weight.

The upper wall of the housing may include thick portions configured to come into contact with the ceiling wall of the case, and the thick portions may include thick portions arranged at positions facing the other end of the coil spring. According to this configuration, the biasing force transmitted from the coil spring via the case can be received in a dispersed manner by the thick portions. This can strengthen resistance to the creep phenomenon in a high-temperature environment even if the housing is made of synthetic resin. Further, the thick portions are formed at the positions of the upper wall of the housing facing the upper end of the coil spring. Therefore, it is possible to build a structure mechanically strong and stable against the biasing force of the coil spring as the connector, and it is also possible to use a coil spring having an even larger spring force.

The terminal may further include a second conductive member sandwiched between the other end of the coil spring and an inner wall of the ceiling of the case, and a wire may connect the first and second conductive members. According to this configuration, the second conductive member is interposed between the coil spring and the ceiling wall of the case, the biasing force of the coil spring can be first received by the second conductive member. This enables the biasing force to be received at dispersed positions as compared to the case where the biasing force of the coil spring is directly received by the ceiling wall of the case. As a result, it is also possible to reduce the thickness of the ceiling wall of the case or alternatively use a coil spring having an even larger spring force.

The connector disclosed by this specification can cope with a high environmental temperature and a large biasing force of the coil spring.

DETAILED DESCRIPTION

1. Configuration of Connector

Figure 1:
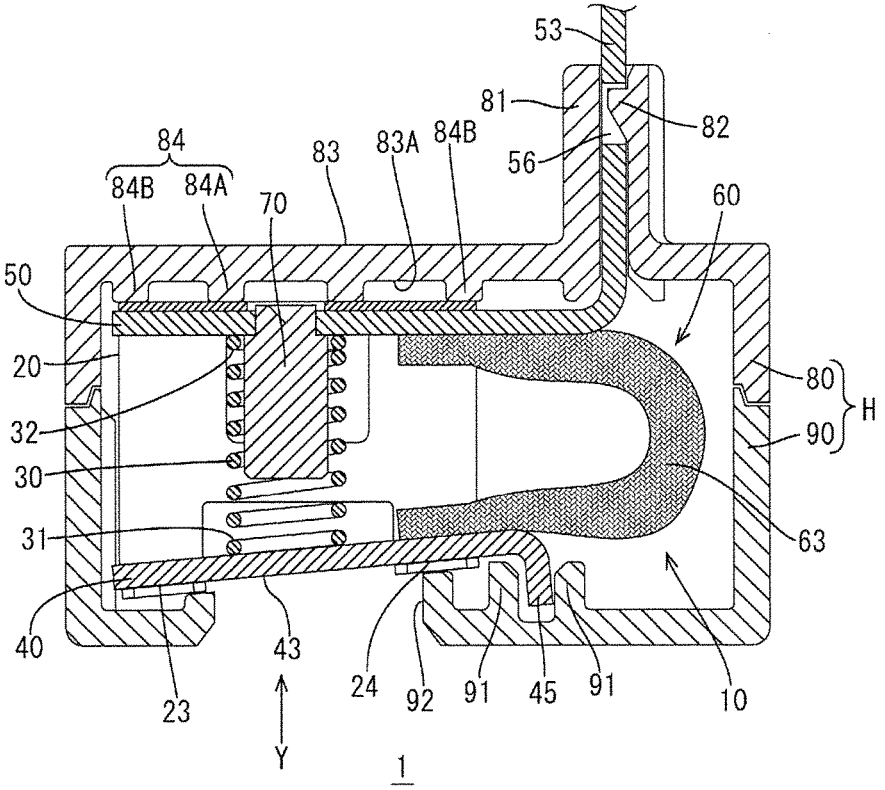
FIG. 1 is a section of a connector in an embodiment.

An embodiment is described with reference to FIGS. 1 to 13. A connector 1 of this embodiment includes a terminal 10 and a housing H, as shown in FIG. 1. Note that FIG. 1 is a section of the terminal 10 corresponding to a line B-B in FIG. 9 when the terminal 10 is mounted in the housing H.

The connector 1 is for electrical connection of an inverter and a motor provided in a vehicle in this embodiment. However, the connector 1 is not limited to this. Further, since a three-phase alternating current normally is used when a motor is inverter-controlled, the connector 1 includes three terminals. However, since the configuration of each terminal is the same, only one terminal 10 is described in the following description. Further, concerning the connector 1, only parts commonly relating to each terminal 10 are described.

1-1. Terminal

Figure 2:
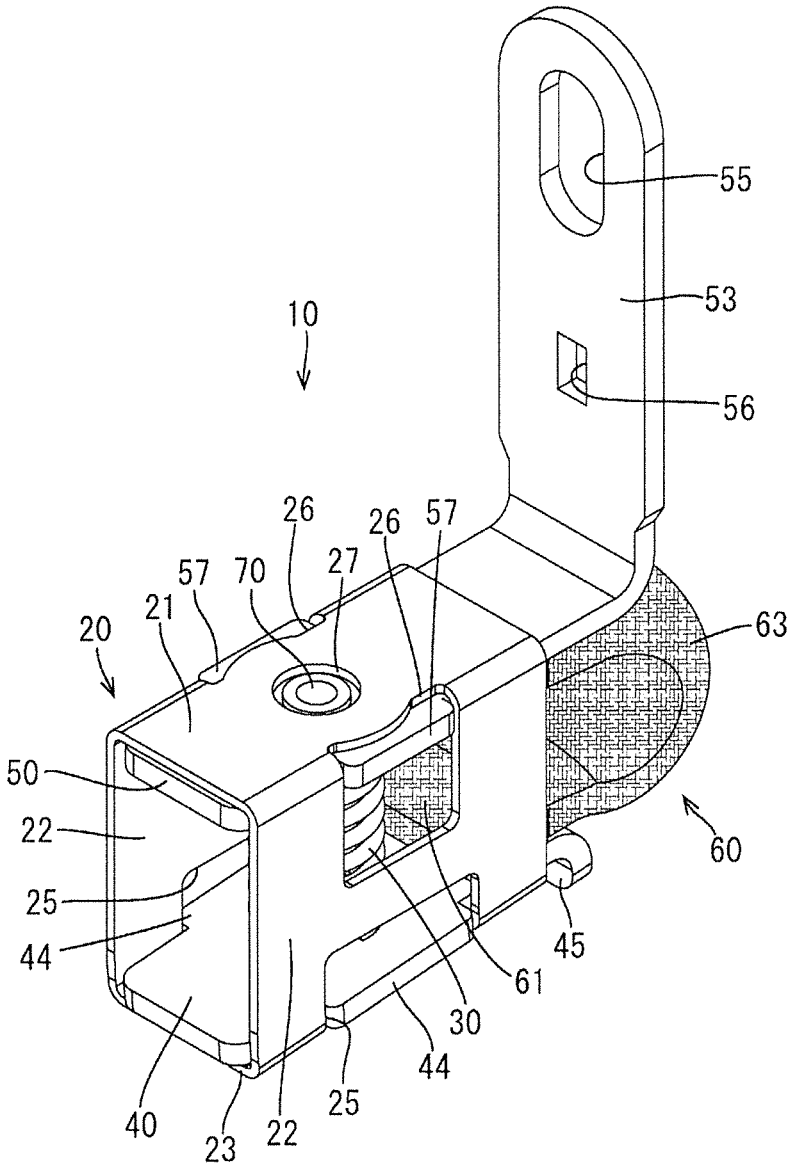
FIG. 2 is a perspective view of a terminal fitting included in the connector.

As shown in FIG. 2, the terminal fitting 10 includes a case 20, a coil spring 30 accommodated in a compressed state inside the case 20, a first conductive member 40 and a second conductive member 50 disposed on both ends of the coil spring 30 and a wire 60 for conductively connecting the conductive members 40, 50. The wire 60 in this embodiment is a braided wire made of metal wires of copper alloy or the like.

Figure 3:
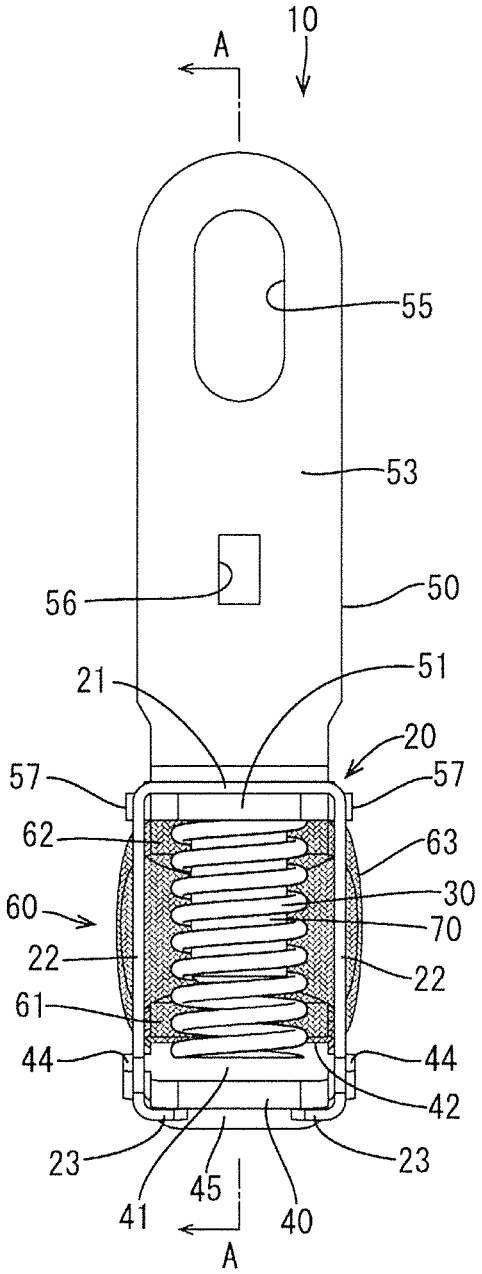
FIG. 3 is a side view of the terminal fitting viewed from a side opposite to a wire.
Figure 4:
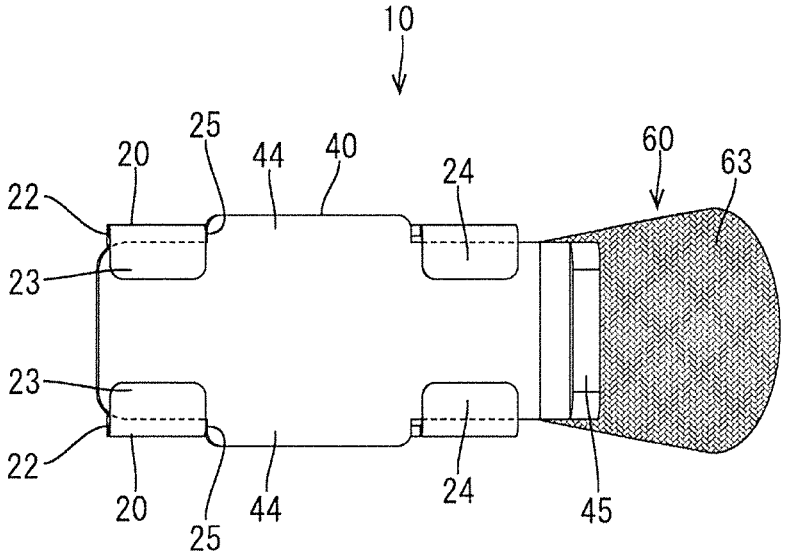
FIG. 4 is a bottom view of the terminal fitting.

The case 20 is made of a metal material and formed by press-working one metal plate made of, for example, a SUS (stainless steel) material or the like. Note that the metal material is not limited to the SUS material. As shown in FIGS. 2 and 3, the case 20 includes a ceiling wall 21, two side walls 22 extending down from both sides of the ceiling wall 21 and supports 23, 24 extending in from the lower ends of the side walls 22 while facing the ceiling wall 21. As shown in FIG. 4, the supports 23, 24 are composed of two first supports 23 disposed on a shown left side of the first conductive member 40 and two second supports 24 disposed on a shown right side of the first conductive member 40.

Figure 5:
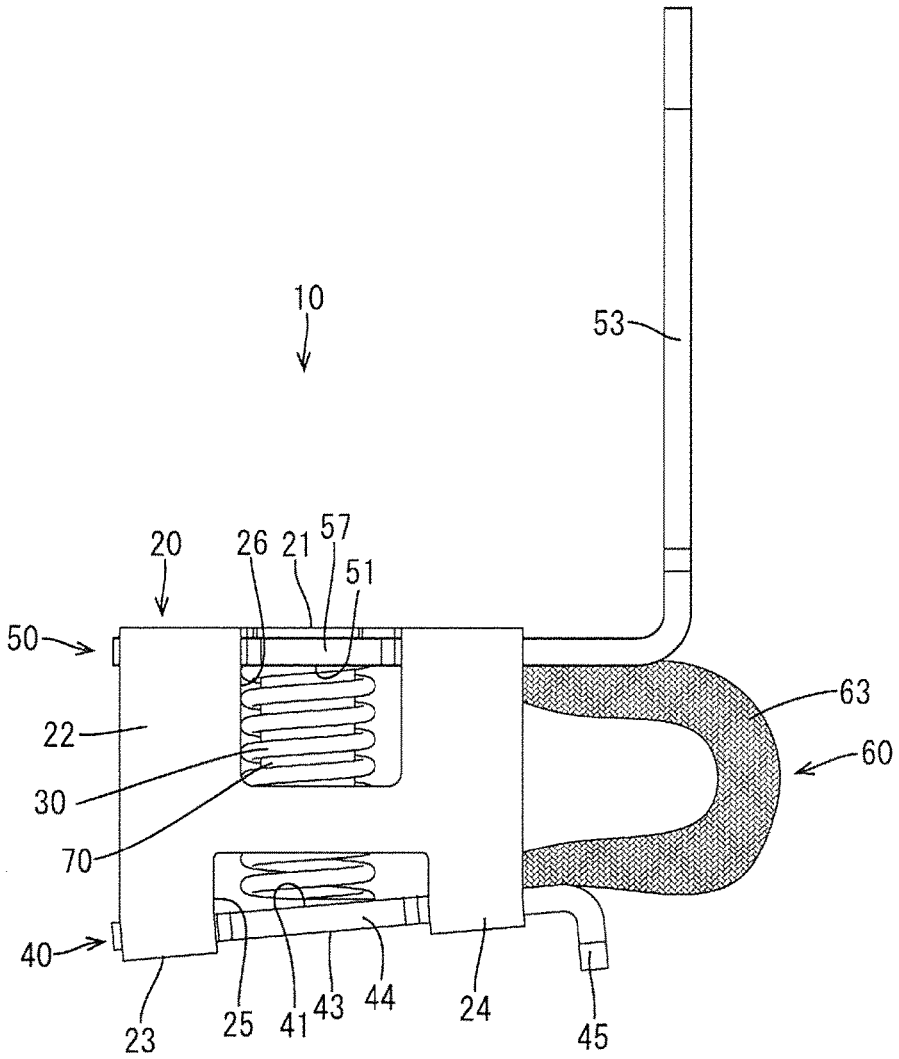
FIG. 5 is a front view of the terminal.
Figure 6:
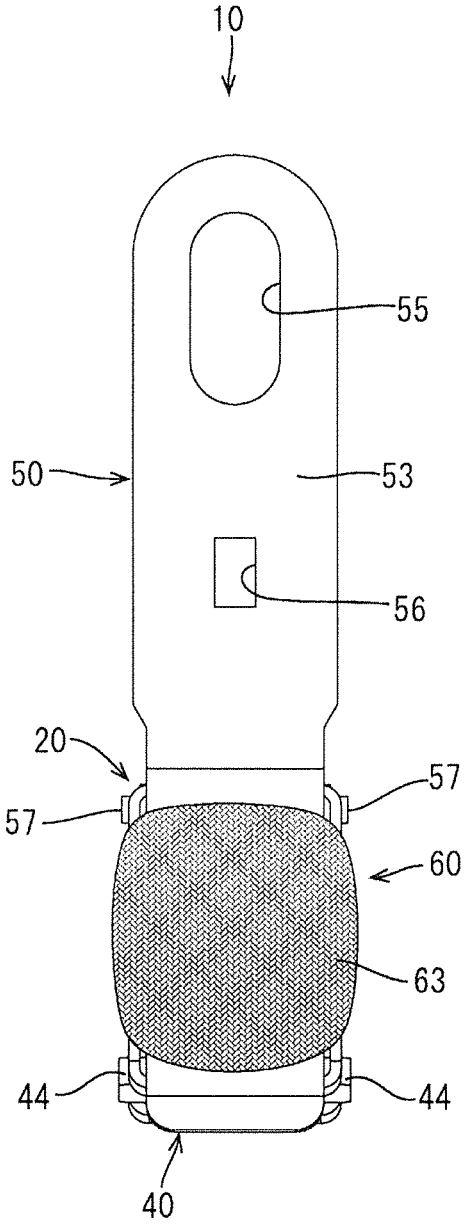
FIG. 6 is a side view of the terminal viewed from the wire side.
Figure 7:
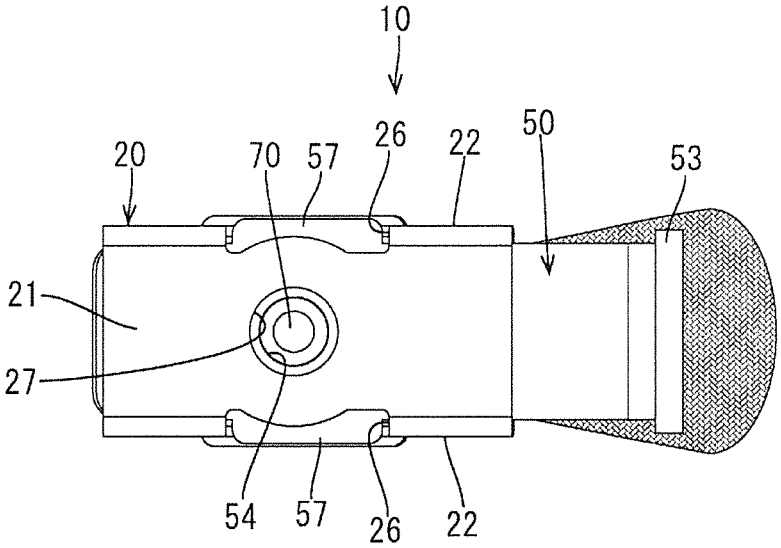
FIG. 7 is a plan view of the terminal.

As shown in FIG. 5, a first opening 25 is provided between the first support 23 and the second support 24 in each side wall 22. A second opening 26 narrower and vertically longer than the first opening 25 is provided above the first opening 25 in each side wall 22. Further, as shown in FIG. 7, an escaping hole 27 penetrates through the ceiling wall 21. The escaping hole 27 is located between the two second openings 26.

Figure 8:
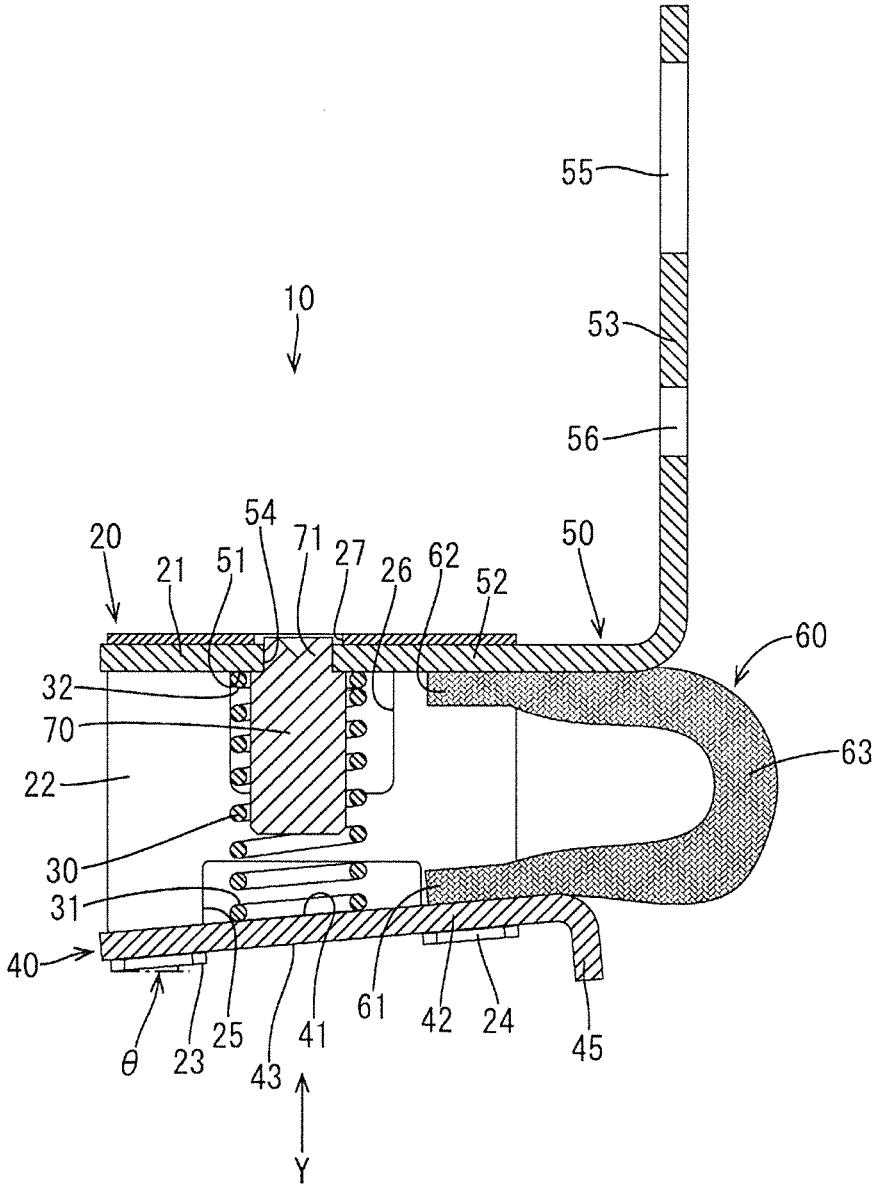
FIG. 8 is a section along A-A in FIG. 3.

Further, as shown in FIG. 8, an interval between the first supports 23 and the ceiling wall 21 is larger than that between the second supports 24 and the ceiling wall 21. In other words, the first supports 23 and the second supports 24 are arranged such that the interval between the first supports 23 and the ceiling wall 21 and that between the second supports 24 and the ceiling wall 21 are different. Further, the first supports 23 and the second supports 24 are coplanar. Specifically, the ceiling wall 21 and a plane formed by the first supports 23 and the second supports 24 are not parallel, and this plane is inclined at a predetermined angle θ so that the second supports 24 are located above the first supports 23 in FIG. 8.

The coil spring 30 is formed by winding a wire material made of metal such as SUS into a coil and accommodated inside the case 20 while being compressed in a compression direction Y (see an arrow of FIG. 8) toward the ceiling wall 21 of the case. Specifically, the coil spring 30 is sandwiched in a compressed state by the first and second conductive members 40, 50. Thus, the coil spring 30 biases both the first and second conductive members 40, 50. By this biasing force, the first conductive member 40 is sandwiched between the lower end 31 of the coil spring 30 and the inner wall of each support 23, 24 and the second conductive member 50 is sandwiched between the upper end 32 of the coil spring 30 and the inner wall of the ceiling wall 21.

The first conductive member 40 is formed by press-working a metal plate material such as copper alloy and includes, as shown in FIG. 8, a spring receiving portion 41 for supporting the lower end 31 of the coil spring 30 and a wire connecting portion 42 supported by the second supports 24 of the case 20. The first conductive member 40 includes a contact 43 with a mating terminal 110 (see FIG. 11) to be described later. Further, the first conductive member 40 is sandwiched between the lower end 31 of the coil spring and the inner wall (42, 43) of the case 20 and the contact 43 is movable in the compression direction Y to further compress the coil spring 30.

The wire 60 in this embodiment is connected to the wire connecting portion 42 by resistance welding. The spring receiving portion 41 is located between the first supports 23 and the second supports 24 and exposed to the outside of the case 20 through the first openings 25 of the case 20. The lower surface of the spring receiving portion 41 serves as the contact 43. The contact 43 is arranged on an axis line of the coil spring 30 and between the first supports 23 and the second supports 24.

The first conductive member 40 is mostly accommodated inside the case 20, but two bulges 44 provided on both side edges of the spring receiving portion 41 and a bent piece 45 provided to extend down from an end edge on the side of the wire connecting portion 42 are disposed outside the case 20. The bulges 44 are accommodated respectively in the first openings 25. The bulges 44 allow an upward movement of the first conductive member 40 while suppressing movements of the first conductive member 40 in a front-rear direction by the contact thereof with opening edge parts of the first openings 25 in the front-rear direction (lateral direction in FIG. 5).

On the other hand, the second conductive member 50 is formed by press-working a metal plate material such as copper alloy. As shown in FIG. 8, the second conductive member 50 includes a spring receiving portion 51 for receiving the upper end of the coil spring 30, a wire connecting portion 52 disposed at a position facing the wire connecting portion 42 of the first conductive member 40 and a device-side connecting portion 53 rising up while being perpendicular to the wire connecting portion 52. A fixing hole 54 penetrates through the spring receiving portion 51. Further, the device-side connecting portion 53 is provided with a bolt hole 55 and a locking hole 56.

A bulge 57 is provided on each side edge of the spring receiving portion 51 (see FIG. 7). The two bulges 57 are accommodated respectively in the two second openings 26. The bulges 57 allow a downward movement of the second conductive member 50 while suppressing movements of the second conductive member 50 in the front-rear direction by the contact thereof with opening edge parts of the second openings 26 in the front-rear direction (lateral direction in FIG. 5).

As shown in FIG. 8, the wire 60 includes a first end part 61 connected to the wire connecting portion 42 of the first conductive member 40, a second end part 62 connected to the wire connecting portion 52 of the second conductive member 50 and an intermediate part 63 coupling the first and second end parts 61, 62. The intermediate part 63 is disposed outside the case 20 and substantially U-shaped. Since the wire 60 is flexible, the intermediate part 63 is deflected and deformed if the first and second conductive members 40, 50 relatively move.

Further, as shown in FIG. 8, a shaft 70 is accommodated inside the coil spring 30. The shaft 70 projects in an axial direction of the coil spring 30 from the second conductive member 50. Specifically, an end part 71 of the shaft 70 penetrates through the fixing hole 54 of the second conductive member 50. The shaft 70 is, for example, made of metal such as brass and has a cylindrical shape. The end part 71 of the shaft 70 is crimped to a hole edge part of the fixing hole 54 by being struck from above and caulked. A part of the end part 71 of the shaft 70 projecting up from the fixing hole 54 is located below the upper surface of the ceiling wall 21 of the case 20 and is accommodated in the escaping hole 27 of the case 20.

The lower end of the shaft 70 is located above the inner wall of the spring receiving portion 41 of the first conductive member 40. Specifically, the lower end of the shaft 70 is disposed at a lowermost position within a range where the lower end of the shaft 70 and the first conductive member 40 do not interfere when the first conductive member 40 is lifted up by the mating terminal 110 (see FIG. 12). Thus, the coil spring 30 will not incline or bend at an intermediate position.

1-2. Housing

As shown in FIG. 1, the housing H is composed of upper and lower insulating members 80, 90 and the terminal 10 is accommodated inside.

As shown in FIG. 1, two position restricting ribs 91 are provided on the bottom wall of the lower insulating member 90. The bent piece 45 of the first conductive member 40 is accommodated between the position restricting ribs 91 to prevent the terminal 10 from moving in the front-rear direction (lateral direction in FIG. 1) inside the housing H. Further, the lower insulating member 90 is provided with a fitting recess 92 having an opening for exposing the contact portion 43 of the first conductive member 40 to the outside.

On the other hand, as shown in FIG. 1, the upper insulating member 80 is provided with a lead-out portion 81 for leading the device-side connecting portion 53 out to the outside of the connector housing H. A locking lance 82 is provided inside the lead-out portion 81. This locking lance 82 is fit into the locking hole 56 of the device-side connecting portion 53 to be locked, thereby suppressing a movement of the second conductive member 50 to the inside of the housing H. The intermediate part 63 of the wire 60 is disposed below the lead-out portion 81. The intermediate part 63 is disposed outside the case 20 inside the housing H, but is disposed not to interfere with the inner wall of the housing H.

Figure 9:
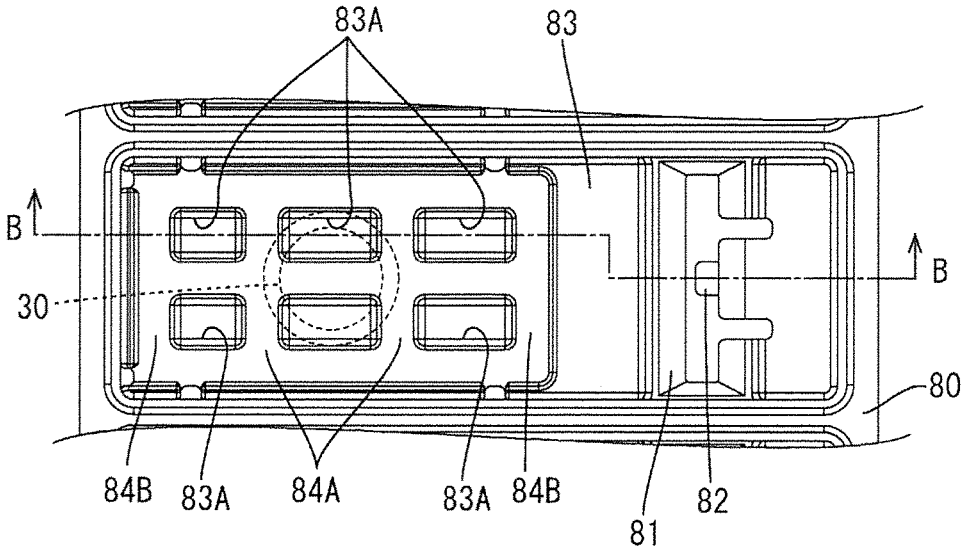
FIG. 9 is a bottom view of an upper insulating member of a housing.

Further, as shown in FIGS. 1 and 9, an upper wall 83 of the upper insulating member 80 includes thick portions 84 configured to come into contact with the ceiling wall 21 of the case 20. The thick portions 84 include first thick portions 84A arranged at positions facing the upper end of the coil spring 30 and second thick portions 84B arranged at positions not facing the upper end of the coil spring 30. Recesses 83A are formed in parts other than the thick portions 84 in an area of the upper wall 83 corresponding to the ceiling wall 21 of the case 20.

2. Relationship with Mating Connector

Figure 10:
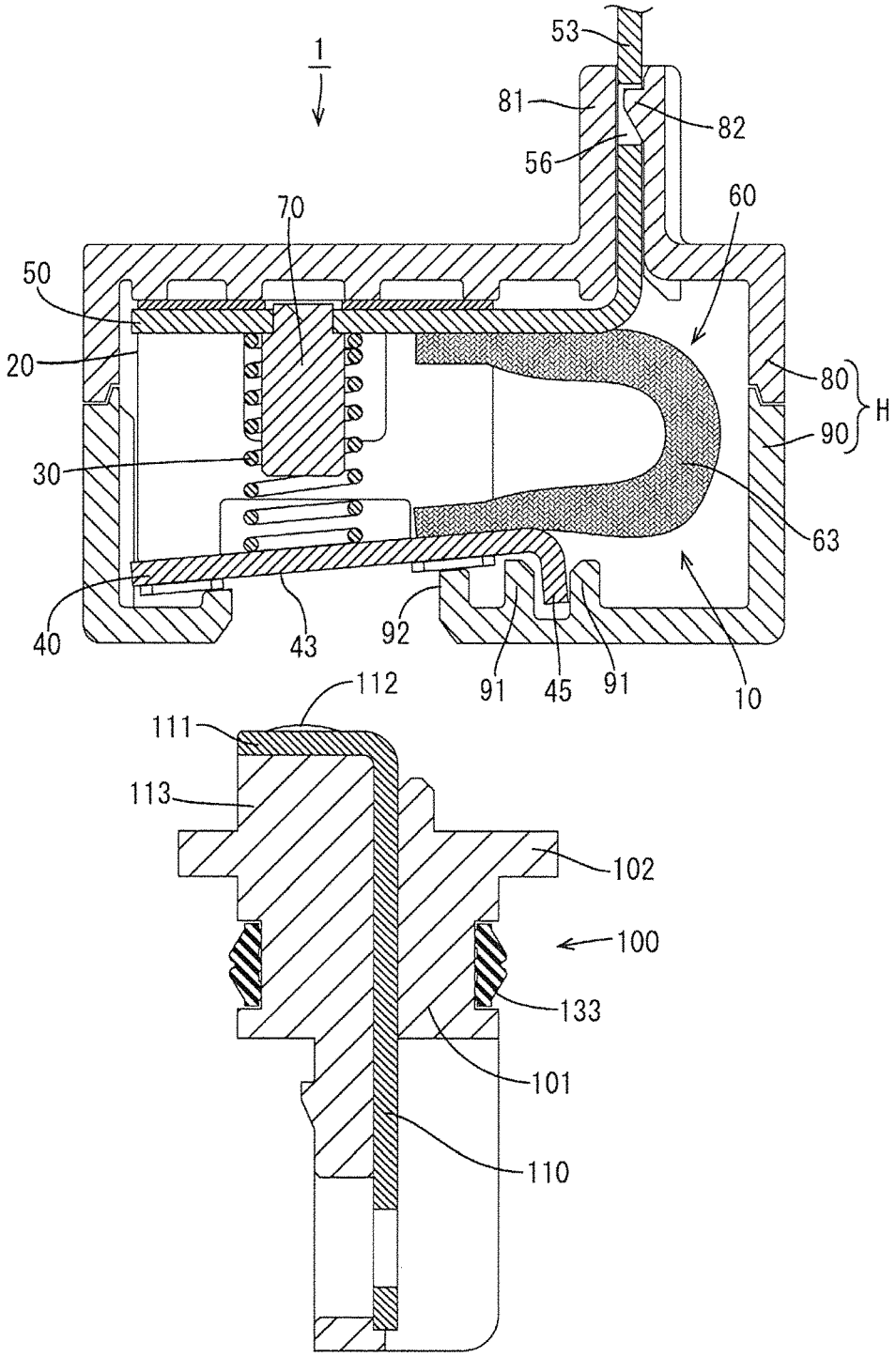
FIG. 10 is a section showing a state before a mating connector is connected to the connector.

A mating connector 100 to be connected to the connector 1 includes a mating housing 101 made of synthetic resin and the mating terminal 110 insert-molded with the mating housing 101, for example, as shown in FIG. 10. The mating terminal 110 is L-shaped, and a mating contact 111 facing the contact portion 43 of the first conductive member 40 is provided on one end of the mating terminal 110. The upper surface of the mating contact 111 is struck from a lower surface side of the mating contact 111 to form a spherical portion 112. The mating contact 111 is disposed on a fitting portion 113 fittable into the fitting recess 92 of the connector 1.

Figure 11:
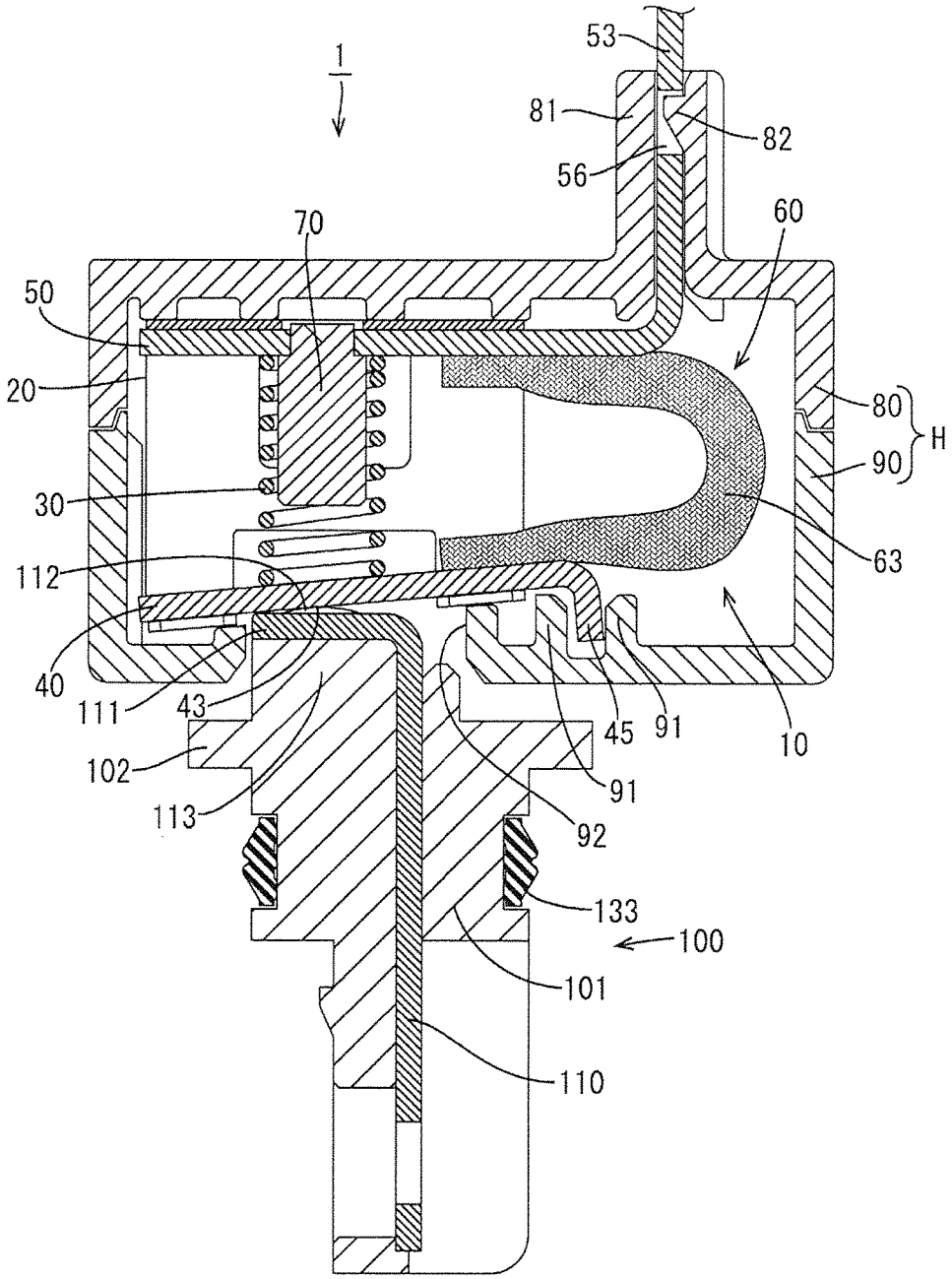
FIG. 11 is a section showing a state where a mating contact is butted against a first conductive member from the state of FIG. 10.
Figure 12:
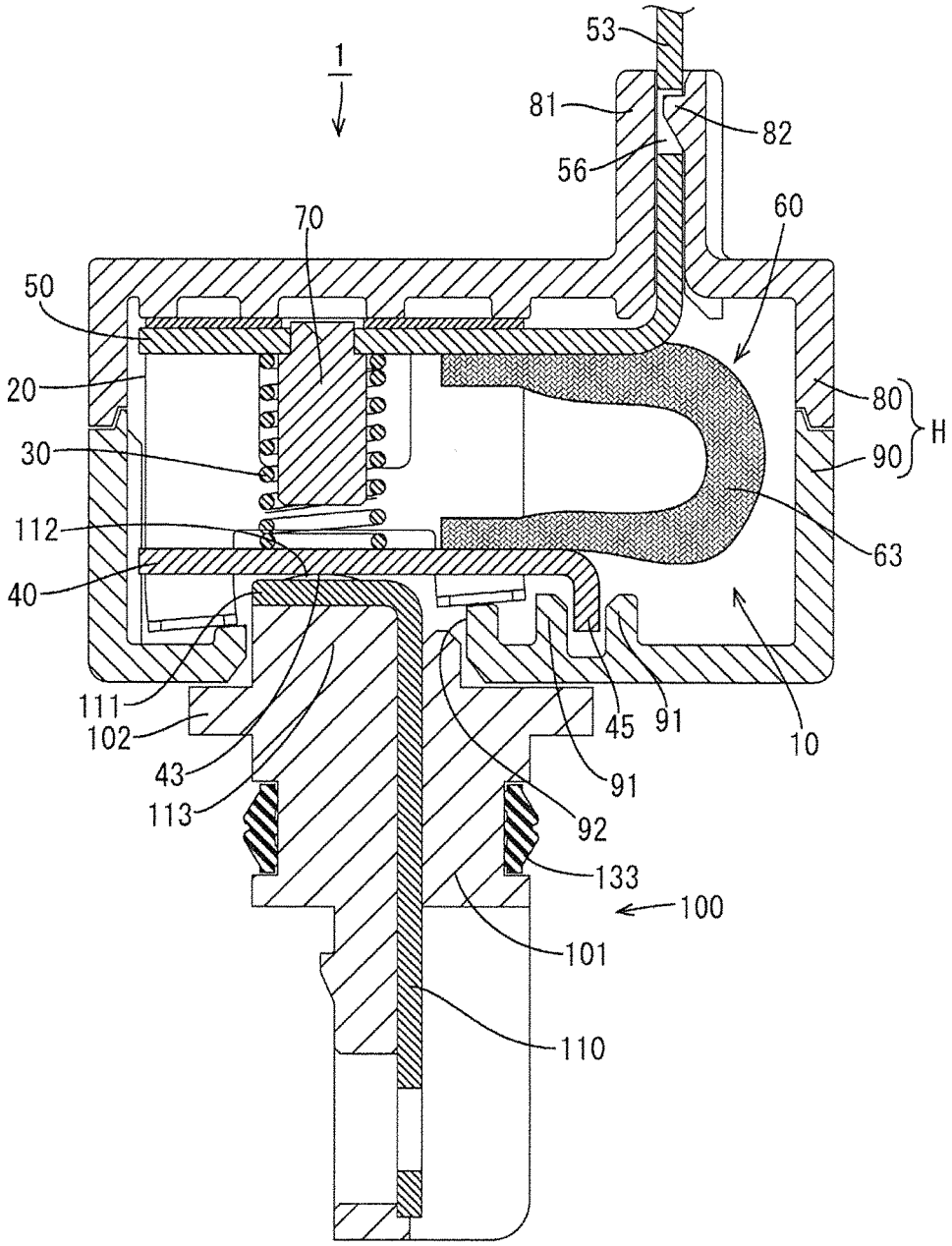
FIG. 12 is a section showing a state where the first conductive member is pushed into a case by butting the mating contact against the first conductive member from the state of FIG. 11.

As the fitting portion 113 of the mating connector 100 is fit into the fitting recess 92 of the connector 1, the spherical portion 112 contacts the contact 43 as shown in FIG. 11. As the fitting portion 113 is fit farther, the first conductive member 40 is lifted up to compress the coil spring 30 as shown in FIG. 12. Further, the wire 60 is deflected slightly by a movement of the first conductive member 40, but does not contact the inner wall of the housing H. The coil spring 30 is set in a compressed state in advance and generates a large spring force merely by being deflected slightly. In this way, the spring force of the coil spring 30 is generated and a predetermined contact pressure is generated between the spherical portion 112 of the mating terminal 110 and the contact 43 of the terminal 10 by this spring force. Thus, the mating terminal 110 and the second conductive member 50 are connected conductively via the first conductive member 40 and the wire 60.

3. Use Example of Connector

Figure 13:
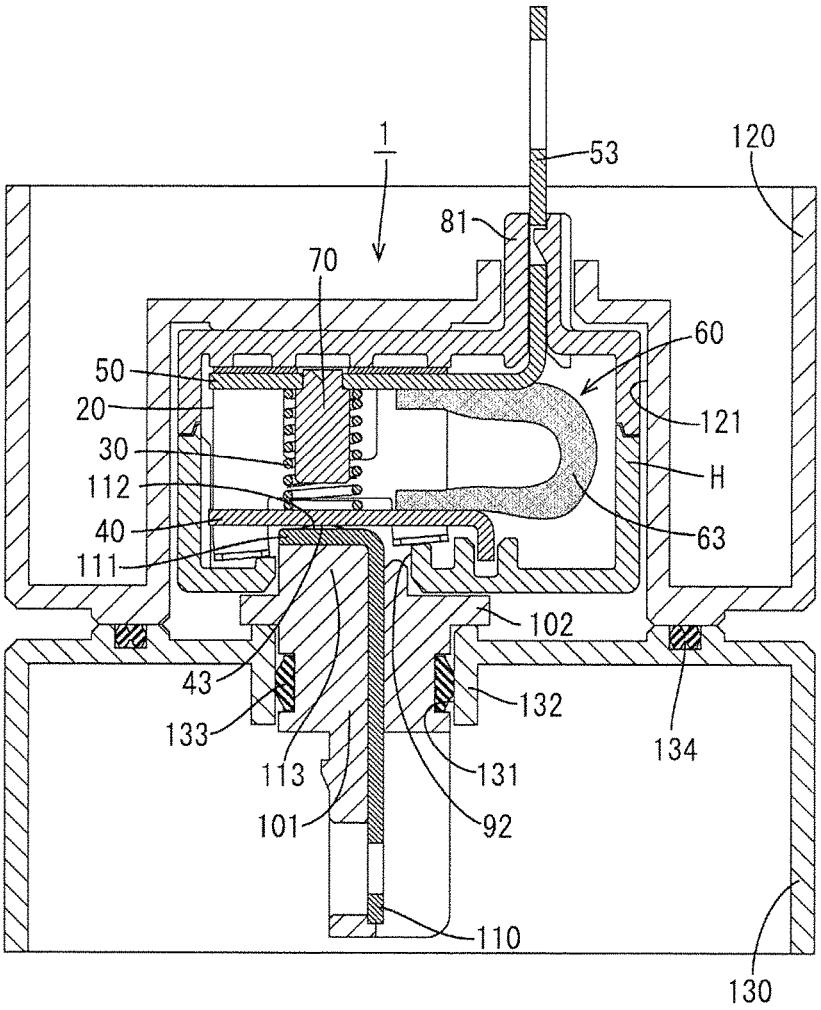
FIG. 13 is a section showing a use example of the terminal of the embodiment.

Next, a use example of the connector 1 of this embodiment is described with reference to FIG. 13. The connector 1 is mounted, for example, in a mounting recess 121 formed by recessing the lower surface of an inverter case 120 of an inverter installed in a vehicle, and only the lead-out portion 81 and the device-side connecting portion 53 of the second conductive member 50 are introduced into the inverter case 120. On the other hand, the mating connector 100 is disposed inside a mounting hole 131 to penetrate through a motor case 130 of a motor installed in the vehicle. A peripheral wall 132 is provided around the mounting hole 131 and a flange 102 of the mating housing 101 is supported on the peripheral wall 132.

Further, a rubber ring 133 is sandwiched between the mating housing 101 and the peripheral wall 132. Furthermore, a packing 134 arranged to circle the mating connector 100 is sandwiched between the upper surface of the motor case 130 and the inverter case 120. In this way, a water shut-off area is secured inside the both cases 120, 130 and the connectors 1, 100 are connected conductively in this water shut-off area. According to this connection method, the mating terminal 110 and the first conductive member 40 need not be fastened by a bolt or the like, and the electrical connection of the connectors 1, 100 is completed merely by mounting the inverter case 120 on the motor case 130. Thus, a connecting operation is simplified and work efficiency is improved.

4. Effects of Embodiment

As described above, in this embodiment, the case 20 for accommodating the terminal 10, specifically the case 20 for accommodating the first conductive member 40 movable in the direction Y to further compress the coil spring 30, is made of the SUS material (metal material). Thus, when the terminal 10 contacts the mating terminal 110, the contact portion 43 of the first conductive member 40 compresses the coil spring 30 farther so that a creep phenomenon does not occur in the case 20 at a high environmental temperature even if the ceiling wall 21 of the case 20 receives a high contact pressure (biasing force) from the coil spring 30.

Thus, the connector 1 of this embodiment can cope with a high environmental temperature and a large biasing force of the coil spring to maintain the reliability of the connector 1.

Further, the upper insulating member 80 of the housing H, includes the upper wall 83 configured to contact the ceiling wall 21 of the case 20 at least when the first conductive member 40 is moved in the compression direction Y to compress the coil spring 30 farther. In particular, in this embodiment, the upper wall 83 of the upper insulating member 80 (housing H) already is held in contact with the ceiling wall 21 of the case 20 by the biasing force of the coil spring 30 before the terminal 10 contacts the mating terminal 110, as shown in FIG. 10.

Thus, when the terminal 10 is joined to the mating terminal 110, the biasing force of the coil spring 30 is transmitted to the housing H via the ceiling wall 21 of the case 20. Specifically, the biasing force of the coil spring 30 can be received also by the housing H and a structure for receiving the biasing force of the coil spring 30 is a double structure. Thus, the thickness of the case 20 can be reduced as compared to the case where the biasing force of the coil spring 30 is received only by the case 20, and the connector 1 can be reduced in weight.

Further, the upper wall portion 83 of the upper insulating member 80 of the housing H, includes the thick portions 84 (84A, 84B) configured to contact the ceiling wall 21 of the case, and the thick portions 84 include the thick portions (first thick portions) 84A arranged at the positions facing the upper end of the coil spring 30. Thus, the biasing force transmitted from the coil spring 30 via the case 20 can be received in a dispersed manner by the thick portions 84. This can strengthen resistance to the creep phenomenon and the like in a high-temperature environment even if the housing H is made of synthetic resin. Further, the thick portions 84A are formed at the positions of the upper wall 83 of the housing H facing the upper end of the coil spring 30. Thus, it is possible to build a structure mechanically strong and stable against the biasing force of the coil spring 30 as the connector 1, and it is also possible to use a coil spring having an even larger spring force.

Further, the terminal 10 includes the second conductive member 50 sandwiched between the other end of the coil spring 30 and the inner wall of the ceiling wall 21 of the case 20 and the wire 60 configured to connect the first and second conductive members 40, 50. According to this configuration, the second conductive member 50 is interposed between the coil spring 30 and the ceiling wall 21 of the case. Thus, the biasing force of the coil spring 30 can be received initially by the second conductive member 50. This enables the biasing force to be received at dispersed positions as compared to the case where the biasing force of the coil spring 21 is directly received by the ceiling wall 21 of the case. As a result, it is also possible to reduce the thickness of the ceiling wall 21 of the case, i.e. the thickness of the case and/or use a coil spring having an even larger spring force.

The invention is not limited to the above described and illustrated embodiment. For example, the following modes also are included.

Although the housing H is divided vertically into the upper insulating member 80 and the lower insulating member 90 in the above embodiment, there is no limitation to this. The housing H may have an integral structure.

Further, although the upper wall 83 of the housing H is configured to come into contact with the ceiling wall 21 of the case when the first conductive member 40 is moved in the compression direction Y to further compress the coil spring 30, there is no limitation to this. Specifically, the upper wall 83 may be configured not to come into contact with the ceiling wall 21 of the case when the first conductive member 40 is moved in the compression direction Y to further compress the coil spring 30.

The upper wall 83 of the housing includes the thick portions 84 configured to come into contact with the ceiling wall of the case 20. However, the housing H may have a constant thickness.

The thick portions 84 include the thick portions 84A arranged at the positions facing the upper end of the coil spring 30. However, the thick portions 84 may not necessarily be arranged at the positions facing the upper end of the coil spring 30.

The case 20 is fixed by the housing H, and the upper wall 83 of the upper insulating member 80 (housing H) already is held in contact with the ceiling wall 21 of the case 20 by the biasing force of the coil spring 30 before the terminal 10 contacts the mating terminal 110 in this embodiment. However, there is no necessary limitation to this configuration. For example, the case 20 may not be fixed by the housing H. Additionally, the upper wall 83 may be configured to first come into contact with the ceiling wall 21 of the case 20 by the biasing force of the coil spring 30 when the terminal 10 contacts the mating terminal 110. Even in this case, the structure for receiving the biasing force of the coil spring 30 when the terminal 10 contacts the mating terminal 110 can be a double structure.

Although the terminal 10 includes the second conductive member 50 sandwiched between the upper end 32 of the coil spring and the inner wall of the ceiling wall 21 of the case and the wire 60 configured to connect the first and second conductive members 40, 50 in the above embodiment, there is no limitation to this. The second conductive member 50 may be omitted or the second conductive member 50 and the wire 60 may be omitted.

LIST OF REFERENCE SIGNS

1 . . . connector
10 . . . terminal
20 . . . case
21 . . . ceiling wall (inner wall)
23 . . . first support (inner wall)
24 . . . second support (inner wall)
30 . . . coil spring
31 . . . lower end of coil spring
32 . . . upper end of coil spring
40 . . . first conductive member
43 . . . contact portion
50 . . . second conductive member
60 . . . wire
80 . . . upper insulating member (housing)
83 . . . upper wall
84, 84A, 84B . . . thick portion
90 . . . lower insulating member (housing)
H . . . housing

The invention claimed is:

1. A connector with a terminal and a housing for accommodating the terminal, wherein the terminal includes:

a case having a ceiling wall, the case being accommodated in the housing;

a coil spring accommodated inside the case while being compressed in a compression direction toward the ceiling wall of the case; and a first conductive member having a contact with a mating terminal, the first conductive member being sandwiched between one end of the coil spring and an inner wall of the case, the contact being movable in the compression direction to further compress the coil spring;

the case being made of a metal material;

the housing including an upper wall configured to come into contact with the ceiling wall of the case at least when the first conductive member is moved in the compression direction to compress the coil spring farther.

2. The connector of claim 1, wherein:

the upper wall of the housing includes thick portions configured to contact the ceiling wall of the case; and the thick portions include thick portions arranged at positions facing the other end of the coil spring.

3. The connector of claim 1, wherein the terminal further includes:

a second conductive member sandwiched between the other end of the coil spring and an inner wall of the ceiling wall of the case; and a wire configured to connect the first and second conductive members.

4. A connector with a terminal and a housing for accommodating the terminal, wherein the terminal includes:

a case having a ceiling wall, the case being accommodated in the housing;

a coil spring accommodated inside the case while being compressed in a compression direction toward the ceiling wall of the case; and a first conductive member having a contact with a mating terminal, the first conductive member being sandwiched between one end of the coil spring and an inner wall of the case, the contact being movable in the compression direction to further compress the coil spring;

the case being made of a metal material;

the terminal further including:

a second conductive member sandwiched between the other end of the coil spring and an inner wall of the ceiling wall of the case; and a wire configured to connect the first and second conductive members.

* * * * *